US010295305B2

(12) United States Patent
Tedder et al.

(10) Patent No.: US 10,295,305 B2
(45) Date of Patent: May 21, 2019

(54) MOLDED HOLSTER COMPONENTS

(71) Applicant: Tedder Industries, LLC, Hayden, ID (US)

(72) Inventors: Thomas Tedder, Hayden, ID (US); Tim Treto, Mead, WA (US)

(73) Assignee: TEDDER INDUSTRIES, LLC, Post Falls, ID (US)

( * ) Notice: Subject to any disclaimer, the term of this patent is extended or adjusted under 35 U.S.C. 154(b) by 826 days.

(21) Appl. No.: 14/605,405

(22) Filed: Jan. 26, 2015

(65) Prior Publication Data

US 2016/0216065 A1 Jul. 28, 2016

(51) Int. Cl.
*F41C 33/02* (2006.01)
*F41C 33/04* (2006.01)

(52) U.S. Cl.
CPC ..... *F41C 33/0263* (2013.01); *F41C 33/0245* (2013.01); *F41C 33/041* (2013.01); *F41C 33/048* (2013.01)

(58) Field of Classification Search
CPC F41C 33/0263; F41C 33/041; F41C 33/0245; F41C 33/048; F41C 33/0209
USPC ..... 224/243, 244, 192, 193
See application file for complete search history.

(56) References Cited

U.S. PATENT DOCUMENTS 4,905,880 A * 3/1990 Cupp ..... F41C 33/0227 224/192
5,421,497 A * 6/1995 Gilmore ..... A45F 5/00 224/192
5,622,295 A * 4/1997 Hellweg ..... F41C 33/0236 224/193
7,258,259 B1 * 8/2007 Owens ..... A45F 5/02 224/192
7,314,152 B1 * 1/2008 Garrett ..... F41C 33/0236 224/192
8,297,562 B1 * 10/2012 Yeates ..... A45F 5/02 224/191
9,033,148 B2 * 5/2015 Adams ..... A45F 5/14 206/349
9,267,760 B2 * 2/2016 Slinkard ..... F41C 33/043
9,404,710 B1 * 8/2016 Beard ..... F41C 33/0209
9,568,275 B2 * 2/2017 Sykes ..... F41C 33/0236
2005/0127121 A1 * 6/2005 Wells ..... F41C 33/0209 224/193
2008/0105721 A1 * 5/2008 Har-Shen ..... F41C 33/046 224/667
2010/0181353 A1 * 7/2010 Craighead ..... F41C 33/0236 224/193
2010/0270349 A1 * 10/2010 Craighead ..... F41C 33/0236 224/587
2012/0305615 A1 * 12/2012 Craighead ..... F41C 33/048 224/587

(Continued)

*Primary Examiner* — Justin M Larson
*Assistant Examiner* — Lester L Vanterpool
(74) *Attorney, Agent, or Firm* — Timberline Patent Law Group

(57) ABSTRACT

Representative implementations of devices and techniques provide a molded backer and/or a molded cover for a holster. The backer may be combined with one or more shell components (i.e., covers) to form a case for a weapon, tool, or other implement. The backer and/or the cover may be formed to include one or more features on a surface of the backer and/or cover, for tuning a relative friction of the surface of the backer and/or cover.

23 Claims, 8 Drawing Sheets

(56) References Cited

U.S. PATENT DOCUMENTS

| | | | | |
|---|---|---|---|---|
| 2014/0027486 | A1* | 1/2014 | McGee | F41C 33/02 224/587 |
| 2014/0117064 | A1* | 5/2014 | Evans | F41C 33/048 224/587 |
| 2014/0158733 | A1* | 6/2014 | McDonnell | B60R 7/14 224/587 |
| 2014/0158734 | A1* | 6/2014 | Bickert | F41C 33/048 224/587 |
| 2014/0217136 | A1* | 8/2014 | Wegner | F41C 33/0227 224/243 |
| 2015/0034683 | A1* | 2/2015 | Tedder | A45F 5/00 224/242 |
| 2015/0034684 | A1* | 2/2015 | Tedder | A45F 5/00 224/242 |
| 2015/0267994 | A1* | 9/2015 | Tedder | A45F 5/00 224/242 |
| 2016/0003578 | A1* | 1/2016 | Vertreese | F41C 33/043 224/192 |
| 2016/0066680 | A1* | 3/2016 | Hazeltine | A45F 5/021 224/676 |
| 2016/0102940 | A1* | 4/2016 | Sykes | F41C 33/0236 224/587 |

* cited by examiner

MOLDED HOLSTER COMPONENTS

BACKGROUND

Implements, such as tools, weapons, and the like, may be encased in a holster for protection of the implement and/or the user, while providing access to the implement. For example, a holster may allow a user to conveniently carry the implement, safely retaining the implement until needed. When the implement is to be used, the user may withdraw the implement from the holster, and then return it to the holster when finished.

In the case of a handgun, the holster should reasonably protect the handgun and the user, and should be convenient to the user for ready use. Accordingly, the holster should retain the handgun until it is to be used, but allow the user to draw the handgun for use without undue effort or difficulty. The holster should be rigid and stable enough to allow the handgun to be repeatedly drawn and reholstered, usually with the same hand. However, the holster should also be flexible enough to be comfortably carried by the user, such as when it is worn on the person of the user for an extended length of time. It can be challenging to balance each of these characteristics.

Further, when the holster is intended to be concealed, some of the desired characteristics (e.g., protection, convenience, retention, access, stability, comfort, etc.) may be sacrificed to provide the concealment.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Introduction

Figure 1:
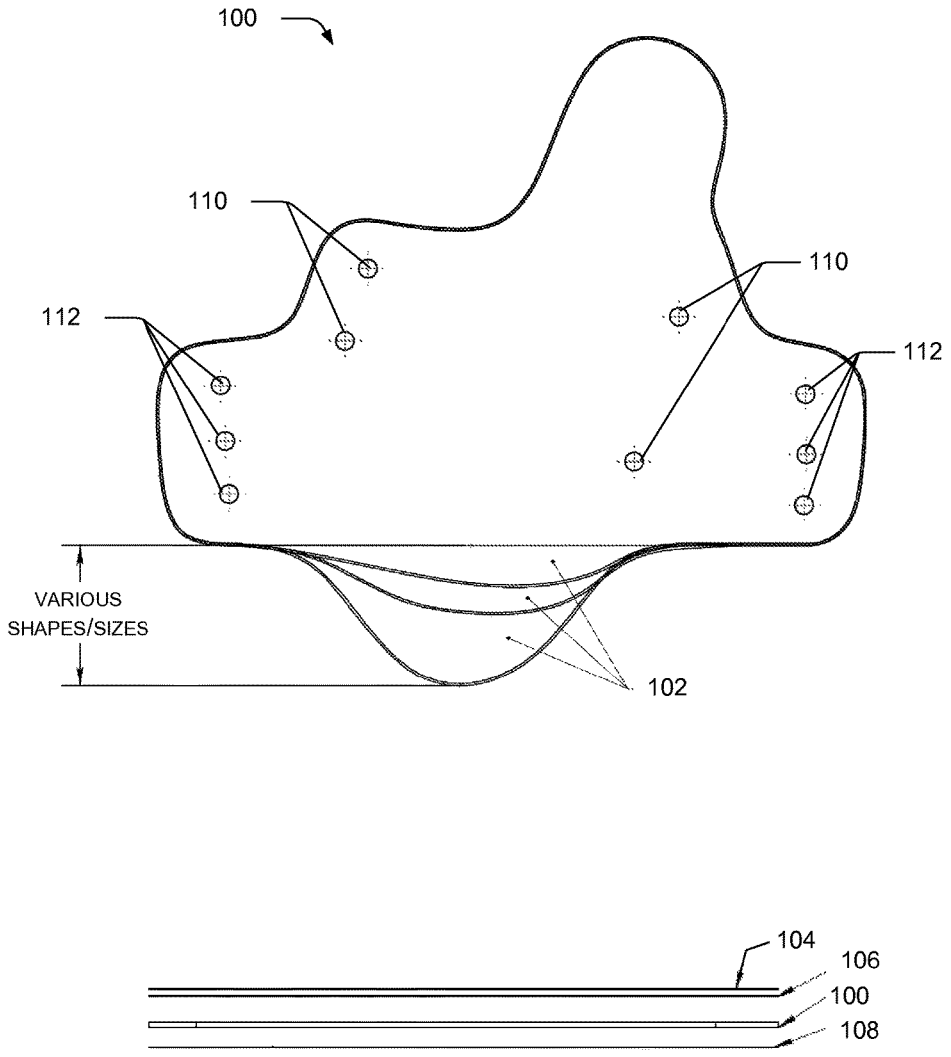
FIG. 1 is a plan view and a profile view of an example holster backer, according to one embodiment.

Representative implementations of devices and techniques provide a molded backer and/or a molded cover for a holster. For example, the backer and/or the cover may be partially or fully molded using an injection molding process, or the like. Injection molding the backer and/or cover allows the backer and/or cover to be formed in a desired shape and configuration, and allows for the customization of the backer, cover, and the holster, if desired. Further, injection molding the backer and/or cover (and/or other parts of the holster) allows for custom finishes, better quality finishes, a simpler manufacturing process, the addition of features to improve performance (e.g., retention, durability, etc.), and reduced cost.

In various implementations, the backer is combined with a cover or shell, and one or more attachment components, to form a case for a weapon, tool, or other implement. For example, the backer and the cover form a holster that at least partially encases the implement in a pocket portion of the holster. In most embodiments, the holster also includes an attachment portion, which may be attached (using clips, for instance) to an article or garment of the user, for carrying or wearing the holster by a user.

In an implementation, the backer includes one or more fasteners molded into the backer and located to couple the cover to the backer. In a further implementation, the backer includes one or more bushings molded into the backer and arranged to space (e.g., offset) the cover from the backer, to determine a retention of the holster, for example. Alternately or additionally, fasteners and/or bushings may be molded into a surface of the cover. Accordingly, the cover may also be partially or fully injection molded in some embodiments.

In an implementation, one or more mounting fixtures for attaching the holster to an article or garment of the user may be molded into the backer. For example, the fixtures may include fasteners for coupling clips or the like to the attachment portion of the holster. In various implementations, the fixtures allow the holster to be adjusted and worn or carried in several configurations (e.g., ride height, angle, etc.).

In an implementation, the backer may be formed to include one or more features molded onto a surface of the backer, for tuning a relative friction of the surface of the backer. For example, the features may be molded into at least a portion of the surface of the backer, and may increase or decrease a friction of the portion of the surface, based on a shape and/or an orientation of the features. In some embodiments, the cover may also be formed to include one or more molded-in features. In an implementation, the retention of the holster (as well as the drawing and reholstering action) may be tuned based on features molded into the backer and/or the cover.

Techniques and devices are discussed with reference to example handgun holsters illustrated in the figures. However, this is not intended to be limiting, and is for ease of discussion and illustrative convenience. The techniques and devices discussed may be applied to any of various cases, case designs, combinations, and the like, (e.g., holsters, sheaths, covers, cases, carriers, scabbards, etc.) for encasing tools, weapons, or other implements, and remain within the scope of the disclosure.

Further, the techniques and devices are discussed and illustrated generally with reference to an inside waistband (IWB) concealed carry holster. This is also not intended to be limiting. In various implementations, the techniques and devices may be employed with outside waistband (OWB) holsters, as well as holsters worn at the back, chest, side, thigh, or ankle of a user, holsters carried in a bag, purse, or pocket, or carried or worn in any other manner. In alternate implementations, the backer and/or the holster may be employed in other ways or with other devices, systems, instruments, or the like.

Implementations are explained in more detail below using a plurality of examples. Although various implementations and examples are discussed here and below, further implementations and examples may be possible by combining the features and elements of individual implementations and examples.

Example Backer

Figure 2:
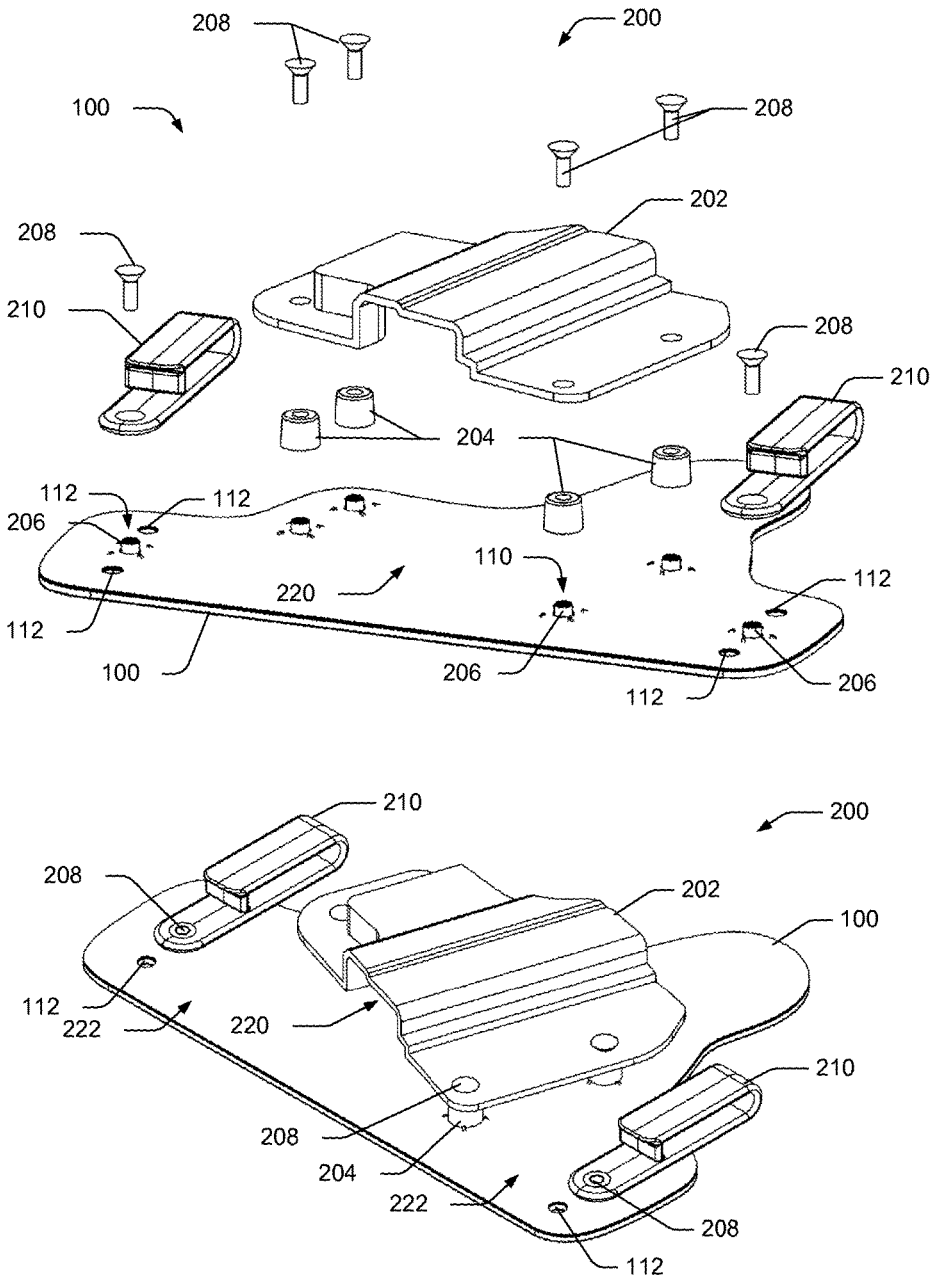
FIG. 2 is an exploded view and a perspective view of a holster assembly, according to one embodiment.

Referring to FIGS. 1 through 6, an example holster backer 100 ("backer") is shown, for use with an implement holster, for instance. In various embodiments, the backer 100 is combined with a cover 202, for example, to form an implement holster 200 (as shown in FIG. 2, for instance). In an implementation, the backer 100 is partially or fully formed using an injection molding process. Accordingly, the backer 100 (and thus the holster 200) can be custom molded as desired for the user and/or as needed for the implement.

As shown in FIG. 1, the backer 100 may be molded to include an extension 102 to custom fit a desired implement. The extension 102 (as well as the backer 100 generally) may be molded in various shapes and sizes to accommodate a particular implement, or a range of implements. For example, the extension 102 may be shaped and sized to accommodate a particular model of handgun, or a series of handguns.

In various implementations, the backer 100 comprises one of various plastics, or the like. For example, the backer 100 may comprise a thermoplastic elastomer (TPE), or similar material. The use of an injection molded TPE provides a flexible backer 100, that is also rigid and stable for drawing and reholstering the implement with the same hand, for instance. In various embodiments, the backer 100 has flexibility and stability properties based on a particular TPE material selected for the backer 100. For example, some TPE materials that may be used include styrenic block copolymers (TPE-s), polyolefin blends (TPE-o), elastomeric alloys (TPE-v or TPV), thermoplastic polyurethanes (TPU), Thermoplastic copolyesters, thermoplastic polyamides, combinations of the same, and the like. Additionally, in some embodiments, the flexibility and stability properties are also based on a thickness of the molded backer 100.

In an implementation, the backer 100 comprises a moisture barrier and/or a corrosion barrier between a user and the implement. For example, the backer 100 forms a moisture-proof barrier against the perspiration of the user, which may tarnish, or otherwise corrode the implement, while the holster is being worn by the user. In other implementations, the backer 100 comprises a protection for the user or the user's clothing against abrasion, heat, or jabbing by the implement.

In various embodiments, as shown in FIG. 1, the molded backer 100 may be combined with one or more additional layers (104, 106, 108) for utility, comfort, or other reasons. For example, the molded backer 100 may be combined with one or more of a lining, padding, and/or covering on part or all of one or both surfaces of the backer 100. In an embodiment, one or more of the additional layers (104, 406, 108) comprises a layer to enhance retention and/or stability characteristics of the backer 100. For instance, one or more of the additional layers (104, 406, 108) may comprise a synthetic material sheeting such as acrylonitrile butadiene styrene (ABS), KEVLAR™, or the like, or a metal such as stainless steel, titanium, etc., or combinations of the same comprising the several layers (104, 406, 108).

In an implementation, as shown in FIG. 1, the backer 100 includes one or more cover fastener locations 110, arranged for coupling a cover 202 to the backer 100. In an example, the cover fastener locations 110 comprise discrete locations for attaching the cover 202 and adjusting the retention of the holster 200 (based on a spacing of the cover 202 from the backer 100, for instance). Further, the backer 100 includes one or more attachment fastener locations 112, arranged for coupling mounting fixtures to the backer, such as clips and the like. In an embodiment, the cover fastener locations 110 and/or the attachment fastener locations 112 comprise fastener components 206. For instance, in various implementations, the cover fastener locations 110 and/or the attachment fastener locations 112 include molded or drilled holes that extend partially or fully through the backer 100, and may extend through one or more of the layers 104, 106, 108, if present. In an alternate embodiment, the cover fastener locations 110 and/or the attachment fastener locations 112 include molded sleeves, molded guides, or other protrusions to assist in locating, guiding, or spacing fasteners to be inserted into the holes 110, 112, or the like.

Figure 3:
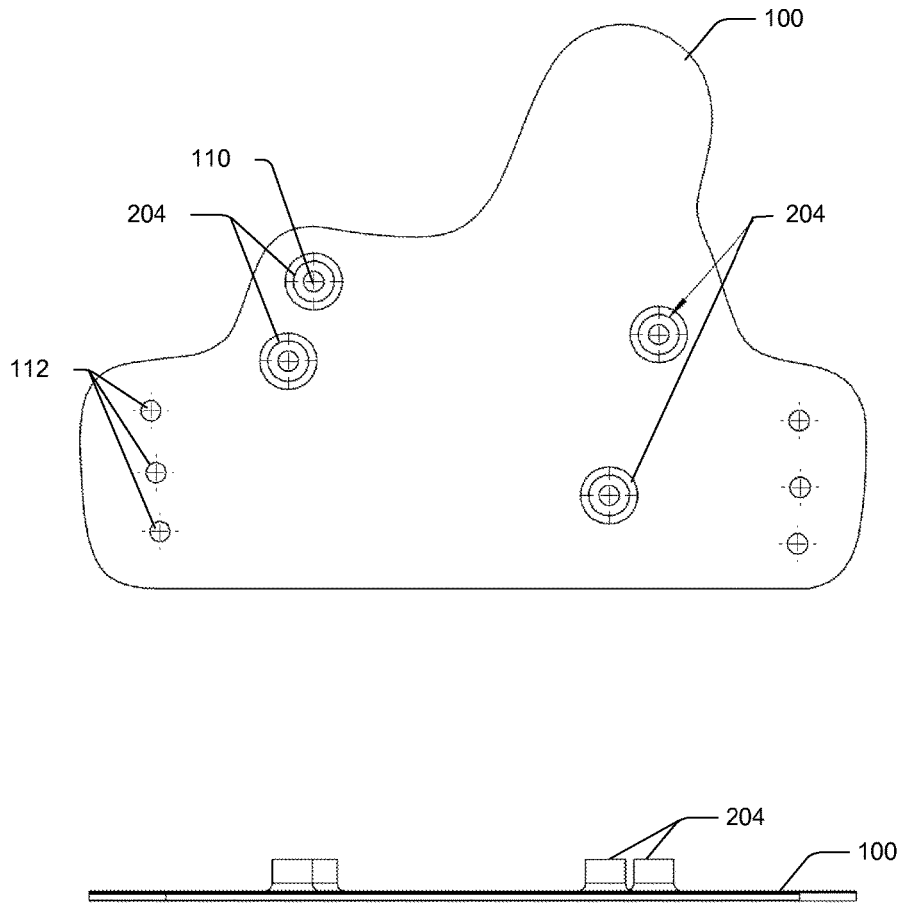
FIG. 3 is a plan view and a profile view of an example holster backer with molded-in bushings, according to one embodiment.

In an implementation, as shown in FIG. 2, the backer 100 includes one or more bushings 204 arranged to space the cover 202 from the backer 100 to determine a retention of the holster 200. For example, the bushings 204 may include offset bushings, spring tensioners, washers, lock mechanisms, spacers, or the like. In one implementation, as shown in FIG. 3, the bushings 204 are molded into the backer 100 and/or the cover 202. In one example, the bushings 204 are molded at the site of the cover fastener locations 110 (as shown in FIG. 3). In an embodiment, the bushings 204 are integrated to the backer 100 and/or cover 202 as part of molding or forming of the backer 100 and/or cover 202.

In an implementation, as shown in FIG. 2, the backer 100 includes one or more fasteners 206, 208 located to couple the cover 202 to the backer 100. For example, the cover 202 may be positioned to at least partially encase a carried implement within the holster 200, and can be fixed to the backer 100 using one or more fasteners 206, 208. In various implementations, fasteners 206, 208 may include mechanical devices such as T-nuts, rivets, screws, Chicago screws, or the like, or a combination of the same.

In an implementation, as illustrated in FIG. 2, the fasteners 206, 208 have multiple components (e.g., a lower component 206 and an upper component 208, for example) that fit together to temporarily or permanently join the cover 202 to the backer 100. In various examples, the fasteners 206, 208 comprise snap-type fasteners, screw and nut fasteners, or the like.

Additionally, the backer 100 may include one or more of the fasteners 206, 208 to couple one or more mounting fixtures 210 to the backer 100. The mounting fixtures 210 may be positioned to attach the backer 100 (and thus the holster 200) to an article or garment of a user, so that the holster 200 may be worn or carried by the user, for instance.

For example, the mounting fixtures 210 may include clips, straps, loops, J-clips, C-clips, keepers, or other devices for mounting the holster 200 on a belt, strap, trouser, or other article or garment.

In an implementation, at least one component (e.g., the lower 206 or the upper 208) of the fasteners 206, 208 is molded into/onto the backer 100 and/or the cover 202. In an embodiment, the fasteners 206, 208 are integrated to the backer 100 and/or cover 202 as part of molding or forming of the backer 100 and/or cover 202. In one example, the lower fastener component 206 is molded into the backer 100 and the upper fastener component 208 is molded into the cover 202 (or vice versa). In alternate examples, only a lower (206) or an upper (208) fastener component is molded into the backer 100 or the cover 202, with the other component (206 or 208) being loose. In other examples, various combinations of the same are included.

In an implementation, the fasteners 206, 208 comprise releasable fasteners, and are arranged to removeably couple one of a multiplicity of covers 202 to the backer 100 in a modular fashion, to carry one of a multiplicity of implements with the holster 200. For example, a user may remove a first cover 202 from the backer 100 and replace it with a second or third cover 202 to use the holster for carrying different implements. In such an example, each cover 202 may be molded to the shape of a specific implement or a range of implements.

Additionally or alternately, the fasteners 206, 208 comprise releasable fasteners arranged to removeably couple a multiplicity of mounting fixtures 210 to the backer 100 for versatility in carrying or wearing the holster 200. For instance a user may remove a first set of mounting fixtures 210 from the backer 100 and replace them with a second set of mounting fixtures 210 to change the manner or location that the holster 200 is carried or worn by the user.

In an embodiment, as shown in FIGS. 1 and 2, the backer 100 includes multiple attachment fastener locations 112, and the one or more adjustable mounting fixtures 210 can be coupled to various ones of the attachment fastener locations 112 to provide multiple configurations for carrying or wearing the holster 200. For example, the ride height and/or the cant of the holster 200 may be configured or adjusted by moving a mounting fixture 210 (or multiple mounting fixtures 210) from a first attachment fastener location 112 to a second attachment fastener location 112.

Example Holster

In an implementation, the holster 200 comprises a concealed carry holster for a handgun (e.g., firearm). In other implementations, as discussed above, the holster 200 comprises a holder for various other tools, weapons, or the like. In various implementations, as shown in FIG. 2, the holster 200 includes an injection molded thermoplastic backer 100 and a cover 202, and may be formed by coupling the cover 202 to the backer 100 as described above. In one implementation, the cover 202 comprises a modular removable thermoplastic shell formed using an injection molding process to conform to a shape of at least a portion of the implement (e.g., firearm) to be holstered.

In an embodiment, as shown in FIG. 2, the backer 100 includes a pocket portion 220 and one or more attachment portions 222. Generally, the pocket portion comprises an area of the backer 100 that is located opposite the cover 202 when the cover 202 is attached to the backer 100. In other words, the pocket portion 220 is the general portion of the backer 100 that encases the implement when the implement is holstered. In the case of a firearm, the cover 202 and the pocket portion 220 of the backer 100 are arranged to encase at least a portion of the firearm.

Further, an attachment portion 222 of the backer 100 comprises an area of the backer 100 that is used to attach the backer 100 to an article or garment of the user. For example, the attachment fastener locations 112 are located at the attachment portion 222 of the backer 100. In some implementations, the attachment portion 222 of the backer 100 comprises the area of the backer 100 that is not the pocket portion 220. In other implementations, the pocket portion 220 and the attachment portion 222 may overlap and/or be one and the same.

Figure 4:
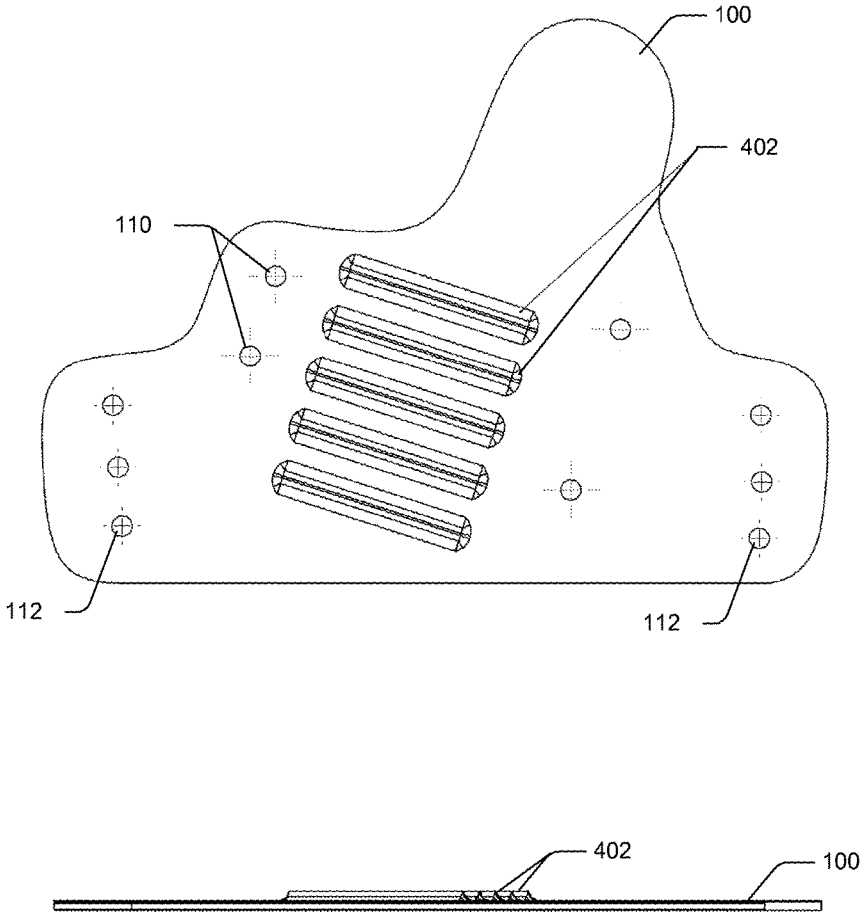
FIG. 4 is a plan view and a profile view of an example holster backer with molded-in features, according to one embodiment.
Figure 5:
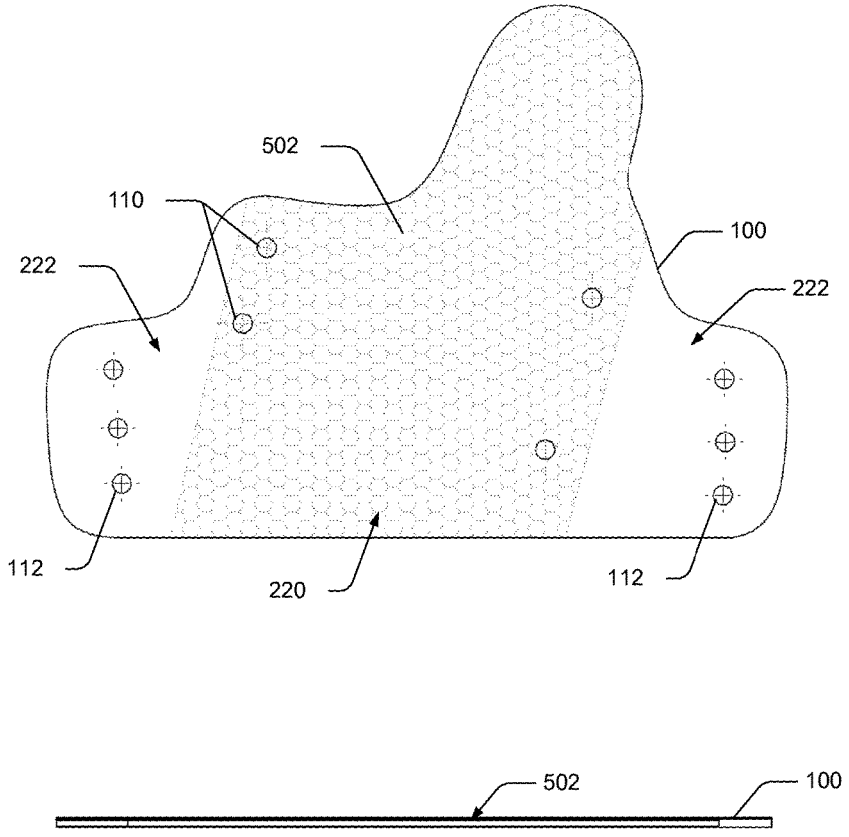
FIG. 5 is a plan view and a profile view of an example holster backer with molded-in features, according to another embodiment.
Figure 6:
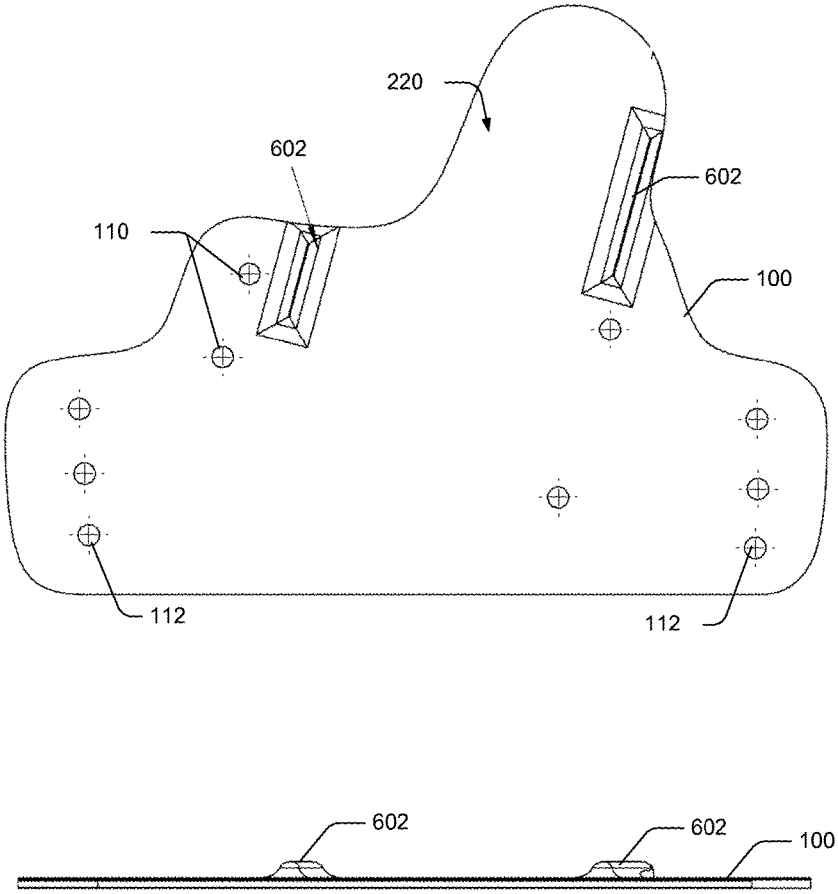
FIG. 6 is a plan view and a profile view of an example holster backer with molded-in features, according to an additional embodiment.

Referring to FIGS. 4-6, in an implementation, the backer 100 includes one or more features, such as features 402, 502, and 602, molded into at least a portion of a surface of the backer 100. In one implementation, the one or more features, such as features 402 and 502 for example, increase or decrease a friction of the portion of the surface of the backer 100 based on the shape and/or the orientation of the one or more features 402, 502. In another implementation, the one or more features, such as features 602, for example, guide the location or direction of the implement as it is moved within the holster 200.

In another implementation, the holster 200 includes one or more molded-in features, such as features 402, 502, and 602 for example, arranged on a surface of the backer 100 and/or a surface of the cover 202. In one implementation, the one or more molded-in features, such as features 402 and 502 for example, increase or decrease a friction of the surface of the backer 100 and/or the surface of the cover 202 based on the shape and/or the orientation of the one or more molded-in features 402, 502. In another implementation, the one or more features, such as features 602 for example, guide the location or direction of the implement as it is moved within the holster 200.

In various embodiments, the one or more molded-in features 402, 502, and 602 are arranged on a surface of the pocket portion 220 and/or on a surface of the cover 202 facing the pocket portion 220 of the backer 100. In the embodiments, the one or more molded-in features, such as features 402 and 502 for example, determine a retention of the holster 200. For example, the location, shape, and orientation of the features 402, 502 can facilitate or inhibit the ease with which the implement moves out of the holster 200, including decreasing or increasing the force needed to remove the implement from the holster 200. In such embodiments, the retention of the holster 200 may be tuned by altering physical characteristics of the features 402, 502, including the size, shape, spacing, location, orientation, quantity, area, etc. of the features 402, 502. In various embodiments, forming the backer 100 and/or the cover 202 using an injection molding process allows the physical characteristics of the features 402, 502, and 602 to be fully customized and tuned for the desired retention and/or guide results.

In various other embodiments, the one or more molded-in features 402, 502, and 602 are arranged on other portions of the backer 100 and/or the cover 202. For example, in one embodiment, the features 402, 502, and 602 are arranged on an attachment portion 222 of the backer 100, adding friction and assisting in reducing movement of the holster 200 when it is attached to an article or garment of the user. In other embodiments, the features 402, 502, and 602 are arranged on other portions of surfaces of the backer 100 and/or the cover 202, as desired.

Referring to FIG. 4, a backer 100 is illustrated with one example of molded-in features 402. Features 402 include protrusions extending from the surface and/or cavities into the surface of the backer 100 and/or the cover 202. The illustration of features 402 is not intended to be limiting. The protrusions and/or cavities of the features 402 may have various shapes (e.g., pointed, rounded, blunted, rectangular, etc.), sizes, layout, arrangement, spacing, and quantities, and may be oriented at various angles with respect to the surface of the backer 100 and/or the cover 202, to achieve desired friction results. In other words, orienting includes that the protrusions extend from the surface of the backer 100 and/or the cover 202 at an angle, rather than perpendicular to the surface of the backer 100 and/or the cover 202.

For example, in an embodiment the one or more molded-in features 402 are shaped, arranged, and/or oriented to increase friction to an object (such as the implement, for example) moving against the one or more molded-in features 402 in a first direction and to decrease friction to the object moving against the one or more molded-in features 402 in a second direction. This may be achieved by orienting the features 402 at an angle that points more or less in the second direction, for example. In other embodiments, the one or more molded-in features 402 are shaped, arranged, and/or oriented to increase (or decrease) friction to an object moving against the one or more molded-in features 402 in multiple directions or in any direction.

In various embodiments, various portions of a surface of the backer 100 and/or the cover 202 may be molded with different features 402, resulting in different coefficients of friction on the different portions. For example, in one embodiment, the one or more molded-in features 402 includes a first set of molded-in features 402 having a first coefficient of friction based on a first shape and a first orientation of the first set of molded-in features 402, and one or more additional sets of molded-in features 402 having other coefficients of friction based on other shapes and other orientations of the one or more additional sets of molded-in features 402.

Referring to FIG. 5, a backer 100 is illustrated with one example of molded-in features 502. Features 502 include patterns, textures, and the like, molded into the surface of the backer 100 and/or the cover 202. The illustration of features 502 is not intended to be limiting. Features 502 may have various shapes, sizes, layout, arrangement, spacing, and quantities, and may be molded onto a surface of the pocket portion 220 as shown, or molded onto a surface of an attachment portion 222, an opposite surface of the backer 100, or various parts of either surface of the backer 100 and/or the cover 202. In an implementation, molded-in features 502 on a portion of a surface of the backer 100 and/or the cover 202 change a coefficient of friction of the surface of the backer 100 and/or the cover 202, based on the physical characteristics of the features 502.

In various embodiments, various portions of a surface of the backer 100 and/or the cover 202 may be molded with different features 502, resulting in different coefficients of friction on the different portions. For example, in one embodiment, the one or more molded-in features 502 includes a first set of molded-in features 502 having a first coefficient of friction based on a first pattern or texture of the first set of molded-in features 502, and one or more additional sets of molded-in features 502 having other coefficients of friction based on other patterns or textures of the one or more additional sets of molded-in features 502.

Referring to FIG. 6 a backer 100 is illustrated with one example of molded-in features 602. Features 602 include protrusions, cavities, patterns, textures, and the like, molded into the surface of the backer 100 (within the pocket portion 220) and/or the cover 202. The illustration of features 602 is not intended to be limiting. Features 602 may have various shapes, sizes, layout, arrangement, spacing, and quantities.

In various implementations, features 602 provide guides for alignment or directing the motion of the implement within the pocket portion 220 of the holster 200. The features 602 may be shaped, sized, and laid out based on the intended implement to be holstered and the guiding desired. For example, the features 602 may be located so that they have a narrower spacing for narrower implements, and located with wider spacing for implements with greater width. Further, the features 602 may be shaped and located to conform to the shape of the implement to be holstered, or they may be generally shaped and located to work with a variety of implements.

In various embodiments, the combination of a molded cover 202 and a molded backer 100 with features 602 improves the efficiency of drawing the implement and reholstering the implement. This is due to the guiding action of the features 602 in combination with the molded shape of the cover 202 and the backer 100.

Figure 7:
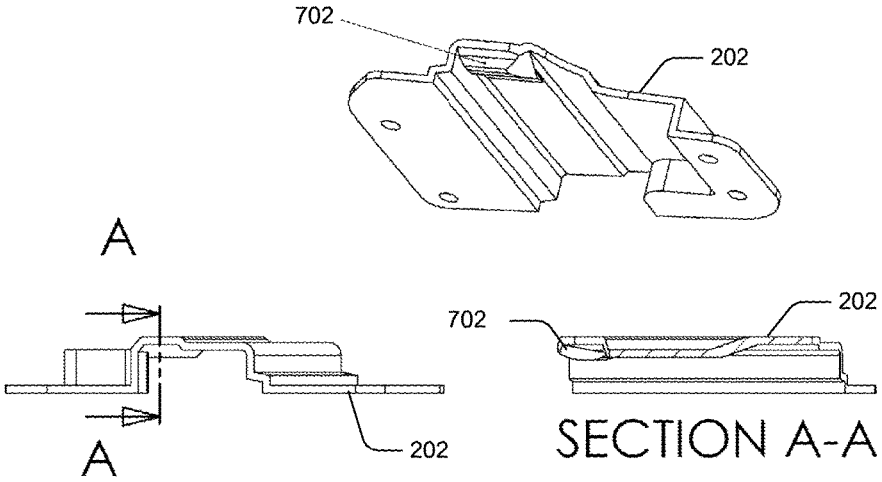
FIG. 7 illustrates a perspective view, a profile view, and a section view of an example cover component with molded-in features, according to an embodiment.

Referring to FIG. 7, in an implementation, the holster 200 includes one or more additional molded features 702 on the backer 100 and/or the cover 202. In various embodiments, the features 702 may include various shapes molded into the cover 202 and/or the backer 100 for guiding the implement during holstering, or for improving retention when the implement is holstered.

For example, in an implementation as shown in FIG. 7, the cover 202 includes molded features 702 comprising a molded protrusion at the entrance of the pocket portion 220 for alignment and or guidance when holstering/reholstering the implement. In the implementation, the features 702 include lead-in/lead-out elements, as shown in the views of FIG. 7.

In alternate implementations, the features 702 may include various other shapes molded into the cover 202 and/or the backer 100, and remain within the scope of the disclosure. For example, in one implementation, the cover 202 includes features 702 comprising a molded flange at the entrance of the pocket portion 220 for improved access to the pocket portion 220 when holstering the implement (e.g., firearm, etc.). In other examples, the features 702 include tabs, grooves, notches, bumps, etc. located at the opening of the pocket portion 220 for guiding the implement during holstering, or for improving retention when the implement is holstered. In some embodiments, the features 702 are located (e.g., on the backer 100 and/or the cover 202) and/or shaped to engage various parts of the implement during reholstering and/or while the implement is holstered. In the case of a handgun, for instance, one or more features 702 may be located and/or shaped to engage the barrel, slide, safety, and/or trigger guard of the handgun for guiding the handgun during holstering, or for improving retention when the handgun is holstered.

The components and techniques discussed herein with respect to the backer 100 and the holster 200 are intended to be used in the production of new holsters or in the retro-fitting of existing holsters. In various embodiments, existing holsters may be upgraded or re-fitted with one or more of the components (e.g., backer 100, cover 202, features 402, 502, 602, 702, etc.) and/or using one or more of the described techniques either individually or in various combinations. In an embodiment, the use of the described components and techniques result in modular holsters 200 that are capable of interchangeable backers 100, covers 202, mounting fixtures 210, bushings 204, and/or fasteners 206, 208. Further, such modular holsters 200 may be configured and/or adjusted for various user wearing or carry options and locations.

As discussed above, the techniques, components, and devices described herein with respect to the implementations are not limited to the illustrations of FIGS. 1-7, and may be applied to other holster devices, and case designs, without departing from the scope of the disclosure. In some cases, additional or alternative components, techniques, sequences, or processes may be used to implement the techniques described herein. Further, the components and/or techniques may be arranged and/or combined in various combinations, while resulting in similar or approximately identical results. It is to be understood that a backer 100 may be implemented as a stand-alone device or as part of another system (e.g., integrated with other components to form a holster 200, as described above). In various implementations, additional or alternative components may be used to accomplish the disclosed techniques and arrangements.

Representative Process

Figure 8:
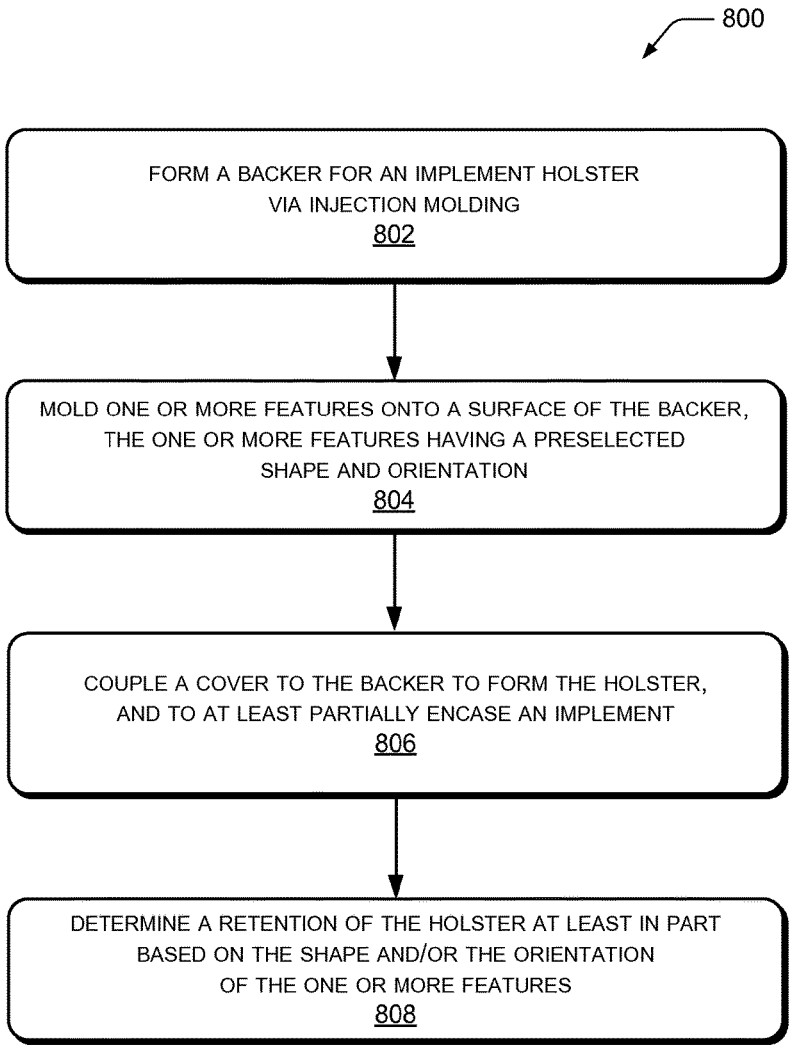
FIG. 8 illustrates a flow diagram of a method of forming a holster using injection molding, according to an implementation.

FIG. 8 is a flow diagram illustrating an example method 800 for forming a holster backer (such as backer 100, for example) and/or a holster (such as holster 200, for example) using an injection molding process, according to various implementations. The process 800 is described with reference to FIGS. 1-7.

The order in which the process is described is not intended to be construed as a limitation, and any number of the described process blocks can be combined in any order to implement the process, or alternate processes. Additionally, individual blocks may be deleted from the process without departing from the spirit and scope of the subject matter described herein. Furthermore, the process can be implemented in any suitable materials, or combinations thereof, without departing from the scope of the subject matter described herein.

At block 802, the process includes forming a plastic backer (such as backer 100, for example) for an implement holster (such as holster 200, for example) via injection molding. In an implementation, the process includes tuning a flexibility, a rigidity, and a stability of the backer based on selecting a plastic (such as thermoplastic) material and a thickness of the backer.

At block 804, the process includes molding one or more features (such as features 402, 502, 602, and/or 702, for example) onto a surface of the backer, the one or more features having a preselected shape and orientation. In various implementations, the one or more features comprise one or more protrusions and/or cavities arranged at a preselected orientation and having a preselected shape. In an implementation, the process includes increasing or decreasing a retention of the holster based on a shape and/or an arrangement of the features. In another implementation, the process includes tuning a friction of the surface of the backer by molding a plurality of molded-in features onto or into the surface of the backer.

At block 806, the process includes coupling a cover (such as cover 202, for example) to the backer to form the holster, and to at least partially encase an implement. In various embodiments, the process includes forming the cover via injection molding. For example, the cover may be injection molded to include one or more features (such as features 402, 502, 602, and/or 702, for example) molded onto a surface of the cover, the one or more features having a preselected shape and orientation. In an implementation, the process includes tuning a friction of the surface of the cover by molding a plurality of molded-in features onto or into the surface of the cover. In an implementation, the process includes removeably coupling the cover to the backer in a modular fashion. In the implementation, one of many covers may be coupled to and removed from the backer interchangeably.

In an implementation, the process includes molding fasteners (such as fasteners 206, 208) located to couple the cover to the backer and/or offset bushings arranged to space the cover from the backer into the backer and/or the cover. In another implementation, the process includes molding spring tensioners or spacers into the backer and/or the cover.

In an implementation, the process includes molding one or more other features onto a surface of the cover, the one or more other features having another preselected shape and orientation. In another implementation, the process includes increasing or decreasing a friction of the surface of the backer and/or the surface of the cover based on the shape and/or the orientation of the one or more features molded into the backer and the one or more other features molded into the cover.

In an implementation, the process includes forming multiple sets of features on the backer and/or the cover, each set of features having a different coefficient of friction based on a shape and an orientation of the set of features.

In a further implementation, the process includes injection molding a shape of at least a portion of the implement into the cover and/or the backer to conform the holster to the implement.

At block 808, the process includes determining a retention of the holster at least in part based on the shape and/or the orientation of the one or more features.

In alternate implementations, other techniques may be included in the process 800 in various combinations, and remain within the scope of the disclosure.

CONCLUSION

While various discreet embodiments have been described throughout, the individual features of the various embodiments may be combined to form other embodiments not specifically described. The embodiments formed by combining the features of described embodiments are also within the scope of the disclosure.

What is claimed is:

1. An apparatus, comprising:

an injection molded backer for an implement holster, the holster comprising the backer and a separate, removable cover;

one or more fastener sleeves molded into the backer at one or more fastener locations, each of the one or more fastener sleeves configured to receive a fastener and located to couple the cover to the backer for encasing at least a portion of a carried implement; and one or more molded-in features integral to a surface of the backer, the one or more molded-in features including one or more textures having a shape adapted to increase or decrease a friction of the surface of the backer to the implement, based on the shape and an orientation of the one or more molded-in features with respect to the surface of the backer, notwithstanding a tension of the backer to the cover.

2. The apparatus of claim 1, further comprising one or more bushings molded into the backer and arranged to space the cover from the backer to determine a retention of the holster.

3. The apparatus of claim 1, further comprising one or more adjustable mounting fixtures releaseably coupled to the backer via molded-in fastener components, for mounting the backer to a user-worn article in multiple configurations.

4. The apparatus of claim 1, further comprising one or more additional layers coupled to the injection molded backer to enhance utility, comfort, stiffness, retention and/or stability of the backer, the one or more additional layers including a plastic layer and/or a metal layer.

5. The apparatus of claim 1, wherein the backer comprises a thermoplastic elastomer (TPE) material, and has flexibility and stability properties based on a TPE material selected and a thickness of the backer.

6. The apparatus of claim 1, wherein the backer comprises a moisture barrier and/or a corrosion barrier between a user and the implement.

7. The apparatus of claim 1, wherein the fastener comprises a releasable fastener arranged to removeably couple one of a multiplicity of covers to the backer in a modular fashion, to carry one of a multiplicity of implements with the holster.

8. A firearm holster, comprising:

an injection molded thermoplastic backer, including a pocket portion and an attachment portion;

one or more fastener sleeves molded into the backer at one or more fastener locations, each of the one or more fastener sleeves configured to receive a fastener;

a separate, removable cover coupled to the backer using the one or more fastener sleeves and the fastener, the cover and the pocket portion arranged to encase at least a portion of a firearm; and one or more molded-in features integral to and arranged on a surface of the backer and/or an inside surface of the cover, the one or more molded-in features including one or more textures having a shape adapted to increase or decrease a friction of the surface of the backer and/or the inside surface of the cover to the firearm, based on the shape and/or an orientation of the one or more molded-in features, notwithstanding a tension of the backer to the cover.

9. The holster of claim 8, further comprising one or more additional molded features on the backer and/or the cover, including a molded protrusion and/or flange at the entrance of the pocket portion for improved access to the pocket portion when holstering the firearm and/or a molded alignment guide within the pocket portion for guiding the firearm during holstering.

10. The holster of claim 8, wherein the cover comprises a modular removable thermoplastic shell formed using an injection molding process to conform to a shape of at least a portion of a firearm.

11. The holster of claim 8, wherein the holster comprises a conceal carry holster for a handgun.

12. The holster of claim 8, wherein the one or more molded-in features are arranged on a surface of the pocket portion and/or on a surface of the cover facing the pocket portion, the one or more molded-in features determining a retention of the holster.

13. The holster of claim 8, wherein the one or more molded-in features includes a first set of molded-in features arranged to form a first coefficient of friction on a surface of the backer and/or a surface of the cover based on a first shape and a first orientation of the first set of molded-in features, and one or more additional sets of molded-in features arranged to form other coefficients of friction on the surface of the backer and/or the surface of the cover based on other shapes and other orientations of the one or more additional sets of molded-in features.

14. The holster of claim 8, wherein the one or more molded-in features are shaped and/or oriented to increase a friction of the surface of the backer and/or the surface of the cover to an object moving against the one or more molded-in features in a first direction and to decrease the friction of the surface of the backer and/or the surface of the cover to the object moving against the one or more molded-in features in a second direction.

15. A method, comprising:

forming a thermoplastic backer for an implement holster via injection molding;

injection molding one or more features onto a surface of the backer, the one or more features integral to a surface of the backer and having a preselected shape and orientation adapted to increase or decrease a friction of the surface of the backer to an implement, based on the shape and the orientation of the one or more features, notwithstanding a tension of the backer to a cover of the implement holster;

coupling the cover to the backer to form the holster, and to encase at least a portion of an implement; and determining a retention of the holster at least in part based on the shape and/or the orientation of the one or more features.

16. The method of claim 15, further comprising tuning a flexibility, a rigidity, and a stability of the backer based on selecting a plastic material and a thickness of the backer.

17. The method of claim 15, further comprising molding fasteners located to couple the cover to the backer and/or offset bushings arranged to space the cover from the backer into the backer and/or the cover.

18. The method of claim 15, further comprising injection molding a shape of at least a portion of the implement into the cover and/or the backer to conform the holster to the implement.

19. The method of claim 15, further comprising molding one or more other features onto a surface of the cover, the one or more other features having another preselected shape and orientation.

20. The method of claim 19, further comprising increasing or decreasing a friction of the surface of the backer and/or the surface of the cover based on the shape and/or the orientation of the one or more features and the one or more other features.

21. The method of claim 19, further comprising forming multiple sets of features on the backer and/or the cover, each set of features forming a different coefficient of friction to a surface of the backer and/or a surface of the cover based on a shape and an orientation of the set of features.

22. The method of claim 15, wherein the one or more features comprise one or more protrusions and/or cavities arranged at a preselected orientation and having a preselected shape.

23. An implement holster, comprising:

a backer, including a pocket portion;

an injection molded cover coupled to the backer, the cover and the pocket portion arranged to encase at least a portion of an implement; and one or more injection molded-in features integral to and arranged on an inside surface of the cover and/or a surface of the backer, the one or more molded-in features having a shape adapted to increase or decrease a friction of the inside surface of the cover and/or the surface of the backer, based on the shape and/or an orientation of the one or more molded-in features, notwithstanding a tension of the backer to the cover.

* * * * *